US007003833B2

(12) United States Patent
Feliciano

(10) Patent No.: US 7,003,833 B2
(45) Date of Patent: Feb. 28, 2006

(54) HAND-HELD CARPENTERS TOOL

(76) Inventor: Pedro Feliciano, 109 Harbor Rd., Staten Island, NY (US) 10303

( * ) Notice: Subject to any disclaimer, the term of this patent is extended or adjusted under 35 U.S.C. 154(b) by 0 days.

(21) Appl. No.: 10/991,568

(22) Filed: Nov. 18, 2004

(65) Prior Publication Data

US 2005/0172416 A1 Aug. 11, 2005

Related U.S. Application Data

(60) Provisional application No. 60/543,648, filed on Feb. 11, 2004.

(51) Int. Cl.
*B26B 11/00* (2006.01)
*B26B 3/06* (2006.01)

(52) U.S. Cl. ..... 7/148; 7/158; 7/118; 30/155

(58) Field of Classification Search ..... 81/44, 81/487, 488, 489, 177.2; 7/148, 158, 118; 30/155

See application file for complete search history.

(56) References Cited

U.S. PATENT DOCUMENTS 1,388,014 A 8/1921 Aiguier
1,390,400 A 9/1921 Threet
1,426,249 A * 8/1922 Bochonok ..... 81/44
2,980,996 A * 4/1961 Beran ..... 30/157
4,238,862 A * 12/1980 Leatherman ..... 7/128
4,890,387 A * 1/1990 Canino ..... 7/118
4,967,623 A * 11/1990 Jackson ..... 81/44
5,023,996 A 6/1991 Pape et al.
D378,337 S * 3/1997 Reynolds et al. ..... D8/14
D386,381 S 11/1997 Black et al.
5,817,000 A * 10/1998 Souder ..... 600/15
5,979,058 A * 11/1999 Henke ..... 30/143
6,006,385 A * 12/1999 Kershaw et al. ..... 7/129
6,088,860 A * 7/2000 Poehlmann et al. ..... 7/128
6,148,700 A * 11/2000 Upholz ..... 81/486
6,243,901 B1 * 6/2001 Elsener et al. ..... 7/118
6,453,564 B1 * 9/2002 Foley ..... 30/359
6,467,173 B1 10/2002 Umstead et al.
6,574,872 B1 * 6/2003 Roberts et al. ..... 30/330
6,622,327 B1 * 9/2003 Rivera ..... 7/128

* cited by examiner

*Primary Examiner*—Lee D. Wilson
*Assistant Examiner*—Alvin J. Grant
(74) *Attorney, Agent, or Firm*—Gerald E. Hespos; Anthony J. Casella

(57) ABSTRACT

A tool assembly includes a handle and a plurality of tools mounted to the handle. Several of the tools can be rotated between a closed position and an open position relative to the handle. The tools include a utility knife, a keyhole saw, a pry bar and a punch. Additionally, the tool assembly includes a recessed rasp for trimming an edge of a sheet of gypsum board.

24 Claims, 8 Drawing Sheets

HAND-HELD CARPENTERS TOOL

This application claims priority on U.S. Provisional Appl. No. 60/543,648 filed Feb. 11, 2004.

BACKGROUND OF THE INVENTION

1. Field of the Invention

The invention relates to hand held tool that can be used by a carpenter or other tradesman to perform a plurality of critical tasks easily.

2. Description of the Related Art

Carpenters require convenient access to a plurality of tools for performing each of a plurality of different functions. As a result, most carpenters wear a tool belt and/or remain close to a box, bucket or bag that contains the tools the carpenter is likely to need during the course of a day. Drywall installation represents a substantial amount of the work done by many carpenters and is a task that many home improvement enthusiasts will attempt.

Drywalls are formed from planar sheets of gypsum board. In particular, a gypsum slurry is formed into a substantially planar shape and secured between two sheets of a fairly sturdy paper. One sheet of paper is more finished than the other and defines the front finished surface of a gypsum board. The gypsum board comes in varying thicknesses from ⅜ inch.

Gypsum board typically is cut by marking a straight line on the finished surface of the gypsum board and then cutting into the gypsum board using a razor sharp utility knife. The cut passes through the paper on the finished side of the gypsum board and partly into the gypsum. The severance of the paper substantially weakens the gypsum board. The carpenter then exerts pressure on the finished side of the gypsum board on either side of the cut. As a result, the gypsum board breaks fairly cleanly along the cut, but remains attached by the paper on the rear surface of the gypsum board. The carpenter then utilizes the razor sharp utility knife to cut through the paper on the rear surface of the gypsum board.

The cut sections of the gypsum board closely match the initial dimensions marked by the carpenter. Additionally, the cut edge typically will be quite smooth adjacent the finished surface of the gypsum board. However, the cut edge will be less smooth at areas closer to the rear surface of the gypsum board due to the breaking of the gypsum material as the gypsum board is folded at the cut. A rough edge may not be a problem in many installation sites, but can be a problem at other locations. In these situations, the carpenter will smooth out the rough edge at the cut. The smoothing typically is carried out with a gypsum board rasp that generally resembles the rough surface of a cheese grater. The rasp also may be employed to make the cut sheet of gypsum board smaller if the initial measurement was inaccurate. In this regard, it is difficult to perform the above-referenced cutting and bending procedure to remove a small sliver of gypsum board (e.g. 0.25 inch–0.50 inch). However, these relatively thin slivers can be removed rather easily with the rasp.

The razor sharp utility knives used by most carpenters can cause very serious cuts. As a result, many utility knives have a retractable blade. The blades dull quite easily during normal usage and must be replaced frequently. Most utility knives have a handle with two opposed halves that are secured together. The halves must be separated to remove a used blade. A new blade then is positioned between the halves of the utility knife and the two halves are secured together again.

The appropriately cut sheet of gypsum board typically is mounted to a wall or ceiling. More particularly, the unfinished rear side of the gypsum board is positioned against the studs, and drywall screws are used to secure the gypsum board to the studs. However, gypsum board must be adapted to accommodate electrical outlets, lighting switches, telephone jacks and heating or air conditioning ducts. The openings required for these utilities often are not at the periphery of the sheet of gypsum board, and hence are not readily cut by the above-described procedure employing the razor sharp utility knife. Accordingly, a carpenter will employ a keyhole saw. A keyhole saw is tapered to a well defined point and has a fairly rough array of teeth along an edge of the saw. The carpenter urges the sharp point of the keyhole saw into and through the gypsum board. The carpenter then uses a reciprocal motion to cut through the gypsum board. The edges cut by a typical keyhole saw will be fairly jagged and may require trimming by the above-mentioned rasp. The typical keyhole saw has a blade about six inches long and a rigid substantially cylindrical handle projecting longitudinally from the blade. This typical shape makes the keyhole saw easy to use. However, the same shape complicates storage and handling between uses. In particular, the keyhole saw is not easily stored or carried on a carpenters belt and can be dangerous when stored in a tool box, bucket or bag.

A drill typically is used to mount drywall screws into the gypsum board. Carpenters generally can locate the studs accurately. However, even an experienced carpenter will periodically miss a stud. In this situation the head of the screw quickly advances into a position substantially flush with the surface of the gypsum board. A screw that is mounted in a stud can be removed easily merely by reversing the drill. However, the threads of a screw that has missed the stud are not engaged with anything. Thus, a reversal of the drill causes the screw to rotate in place, but does not retract the screw from the wall. In this situation, the carpenter must retreat to the tool box to obtain still another tool that can be urged under the head of the screw to bias the screw away from the wall while the drill is being rotated in the reverse direction. A small screwdriver often is used for this purpose. However, the pointed end of the screw driver does not achieve the leverage action for removing the screw. Most pry bars used by carpenters are much too big for this purpose. Hence, the seemingly easy task of removing a screw that has missed a stud can be annoying and time consuming.

The screw holes in the gypsum board and the seams between adjacent sheets of gypsum board are covered with a joint compound. The joint compound is a paste-like material that hardens to a consistency similar to the cured gypsum board. Joint compound, however, generally is not preferred for sealing around windows or doors. Additionally, joint compound often will crack when used at the interface between two surfaces with different expansion and contraction characteristics, such as a joint between gypsum board and wood molding. A more pliable silicone sealant or construction adhesive typically will be used at these locations. Additionally some sheets of wallboard are adhered to a wall rather than using screws. Adhesives and silicone sealants are sold in paperboard or plastic tubes with a pointed plastic nozzle. The tube is sealed by a thin foil membrane and the nozzle initially is tapered to a closed point. The carpenter installs the tube into a caulking gun. The above-described razor sharp utility knife then is used to cut off the tip of the plastic nozzle. A long thin pointed implement then is passed into the cut nozzle sufficiently to puncture the foil so that the adhesive or silicone sealant can be urged from the tube by the caulking gun. Most tools maintained by a carpenter are not well suited to the task of puncturing the foil membrane on a tube of adhesive or silicone sealant. Thus, many carpenters will use a long nail for this purpose.

The tasks described above require frequent access to many different tools including the razor sharp utility knife, the keyhole saw, the rasp, one or more tools to facilitate the removal of screws that have missed a stud and a tool to puncture the foil seal on a tube of silicone sealant. Thus, carpenters spend considerable time looking for and accessing the tools that are required to complete their day-to-day tasks. Many of these tools are not well suited to being suspended on a belt. Additionally, many of these tools are sufficiently sharp to cause cuts or abrasions on the hand. Accordingly, the attempts to access these tools can be dangerous. The likelihood of cuts or scrapes is particularly high in view of the frequency at which these tools are accessed and the preference of workers to complete their tasks as quickly as possible.

Combination tools have been developed for many purposes. These tools often take the form of a conventional pocket knife where implements such as knives, forks, can openers and screwdrivers can be folded into and out of a handle. The available combination tools are not well suited to the many functions that must be carried out by carpenter, as described above. Rather, most combination tools of this type are used more in a recreational context by campers or as part of key chain. The existing combination tools are not adapted for the frequent changing of utility knife blades or the easy retraction of the razor sharp utility knife blades between uses. Drywall rasps are not well suited for folding into and out of the handle of a typical combination tool. Foldable saws have been developed for pruning branches and such, but foldable keyholes saws are not well suited for combination with other tools that may be required by a carpenter. Additionally, all of the above described tools are subjected to considerable forces during normal usage. As a result, the handle must be configured for secure gripping across the palm of the hand of the user and must be sufficiently strong to withstand forces generated during day-to-day use. Furthermore, the tool desirably should be dimensioned for convenient storage, convenient access and safe covering of the sharp elements of the tool.

In view of the above, it is an object of the subject invention to provide a combination tool that can perform all or most of the functions that will be required by a person installing drywall.

It is an additional object of the subject invention to provide a tool that is safe in use, storage and access.

It is a further object of the subject invention to provide a combination tool that incorporates a razor sharp utility knife with blades that can be replaced easily.

Another object of the invention is to provide a combination tool with a keyhole saw that can be replaced if and when necessary.

Still a further object of the subject invention is to provide a combination tool with a rasp that can be replaced if and when necessary.

SUMMARY OF THE INVENTION

The invention relates to a tool assembly that is particularly useful for carpenters and others who install gypsum board. The tool assembly includes a handle dimensioned to be gripped conveniently in one hand of the worker. More particularly, the handle preferably is of approximately polygonal cross section and has opposite first and second ends that are spaced from one another to define a length that preferably is in a range of 4.00–6.00 inches. First and second sidewalls may extend substantially continuously from the first end to the second end of the handle and define a width that preferably is in a range of 1.0–1.5 inch. The sidewalls are spaced from one another to define at least a top cavity extending into the top of the handle. The bottom of the handle preferably is recessed slightly relative to bottom edges of the sidewalls. The top and bottom of the handle are spaced from one another to define a height that preferably is in a range of 1–2 inches.

The tool assembly further includes a utility knife with an elongate housing that has opposite front and rear ends. The rear end of the utility knife is hingedly connected to the second end of the handle so that the utility knife can be rotated from a closed position to an open position relative to the handle. A substantial portion of the utility knife is disposed within the cavity in the top of the handle when the utility knife is rotated into its closed position relative to the handle. However, a major portion of the utility knife projects out from the handle when the utility knife is in its open position.

The housing of the utility knife preferably includes first and second shells releasably connected to one another. The shells are configured to define a blade receiving chamber between the shells. A blade mounting carriage is movably disposed in the chamber. The blade mounting carriage is configured for secure mounting of a utility knife blade so that the blade can be moved longitudinally relative to the utility knife housing. More particularly, the blade mounting carriage can be moved to a retracted position where all of the blade is disposed between the shells of the housing. The blade mounting carriage also can be moved to an actuated position where at least a portion of the utility knife blade projects beyond the front end of the housing. The housing of the utility knife is dimensioned so that the blade projects beyond the first end of the handle of the tool assembly when the utility knife is in the closed position and when the blade mounting carriage is in the actuated position. Thus, a worker can simultaneously grip the handle of the tool assembly and the housing of the utility knife in the cavity of the handle for using the exposed blade of the utility knife. The utility knife housing generally will be rotated out of the handle of the tool assembly to change blades of the utility knife, but will be within the cavity of the handle during most use. The housing of the utility knife may have a magnet that can be used for holding an edge of a metallic tape to help guide a measurement while scoring the gypsum board.

The tool assembly further includes a keyhole saw having opposite front and rear ends and an array of teeth extending along one longitudinal side from the front end to the rear end. The rear end of the keyhole saw is pivoted to the first end of the handle and can be rotated from a closed position to an open position. The keyhole saw is disposed substantially the cavity of the handle when the keyhole saw is in the closed position. However, the keyhole saw extends substantially parallel to the longitudinal direction of the handle when the keyhole saw is in the open position. The teeth of the keyhole saw are oriented to face into the cavity of the handle when the keyhole saw is rotated into the close position. Hence, the teeth of the keyhole saw cannot cut a worker's hand while the worker is using other parts of the tool assembly. The keyhole saw can be replaced easily merely by releasing the keyhole saw from its pivotal connection to the handle and pivotally connecting a new keyhole saw in the handle.

The tool assembly further includes a mini pry bar pivotally connected to the handle and rotatable from a first position where the mini pry bar is in the cavity of the handle to a second position where the mini pry projects from the handle. The pry bar may be pivotally connected about the same pivot point as the utility knife. The end of the pry bar remote from the handle defines a notch with at least one pointed end and a curved bearing surface opposite the notch. The point defined by the notch can be wedged beneath a drywall screw. The pry bar then is used as a lever by rotating the pry bar about the curved bearing surface so that a drywall screw that has not been anchored into a stud can be pull from the gypsum board.

A punch may be pivoted to the handle for rotation from a closed position where the punch is within the cavity of the handle and an open position where the punch projects from the handle. The punch is an elongate rigid cylindrical member with a diameter of about ⅛ inch and is used to pierce the seal on a tube of silicone sealant.

The tool of the subject invention may further include a rasp extending along a surface of the handle opposite to the cavity. The rasp may include an array of serrations sufficiently large to abrade a work surface, such as an edge of a sheet of gypsum board. The rasp can be removed easily from the handle and replaced when worn.

DETAILED DESCRIPTION OF THE PREFERRED EMBODIMENT

Figure 1:
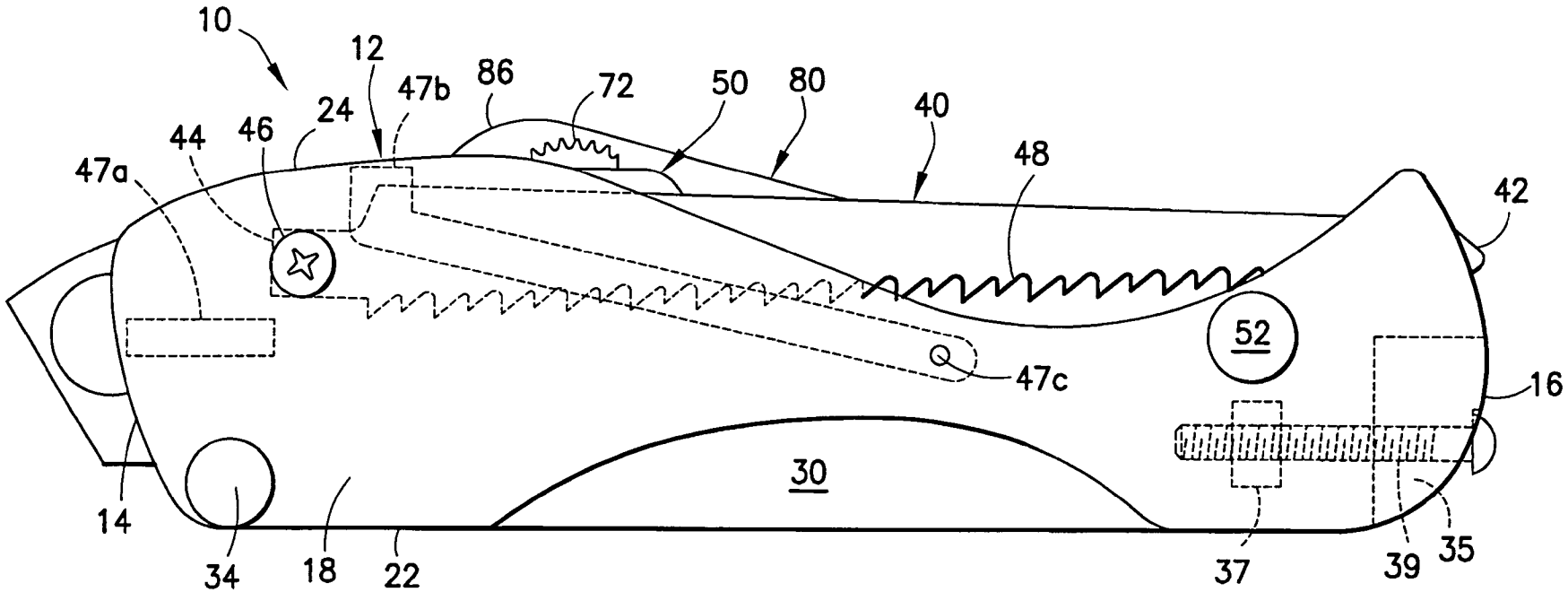
FIG. 1 is a side elevation view of tool in accordance with the subject invention with the various components of the tool in their close condition.

A tool assembly in accordance with the invention is identified generally by the numeral 10 in FIGS. 1–8. The tool assembly 10 includes an elongate handle 12 having a first end 14 and a rounded second end 16. The handle 12 has first and second substantially parallel sidewalls 18 and 20 that extend substantially continuously between the ends 14 and 16. The first sidewall 18 includes opposite bottom and top edges 22 and 24. Similarly, the second sidewall 20 includes opposite bottom and top edges 26 and 28. The bottom edges 22 and 26 of the sidewalls 18 and 20 respectively extend substantially linearly from the first end 14 to the second end 16 of the handle 12. However, the top edges 24 and 28 of the sidewalls 18 and 20 are curved to define a convex section near the first end 14 of the handle 12 and a concave section near the second end 16 of the handle 12. The concave sections near the second end 16 of the handle 18 facilitate access to the components of the tool assembly, as explained further herein and further facilitates gripping during use of the tool assembly 10. Portions of the sidewalls 18 and 20 near the bottom edges 22 and 26 define curvilinear recesses 30 and 32 substantially opposed to and slightly forward of the concave sections of the top edges 24 and 28. The recesses 30 and 32 facilitate griping during use of the tool assembly 10.

The handle 12 further includes first and second spacers 34 and 35 that extend between the sidewalls 18 and 20 to maintain a specified spacing (e.g. 1.0 inch) between the sidewalls 18 and 20. The second spacer 35 is smoothly convex and defines part of the rounded second end 16 of the handle 12.

Figure 4:
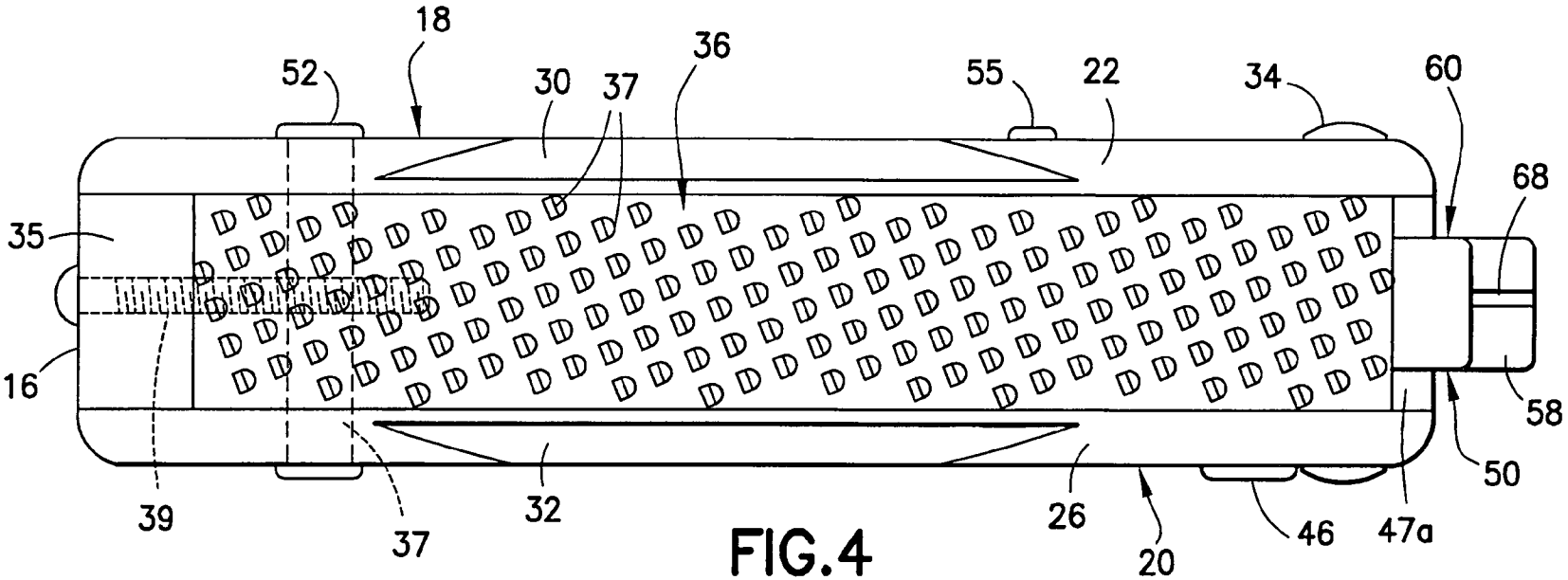
FIG. 4 is a bottom plan view of the tool with the components in their close condition.

A gypsum board rasp 36 is mounted in proximity to the spacers 34 and 35 so that the rasp 36 is recessed approximately the thickness of the rasp 36 up from the bottom edges 22 and 24 of the sidewalls 18 and 20. The rasp 36 is formed with an array of teeth that are configured to abrade an edge of a sheet of gypsum board. The rasp 36 can be of different widths from about ⅜ inch to about 1 inch to conveniently trim the edge of a sheet of gypsum board at any of the commercially available thickness. The recessed disposition of the rasp 36 relative to the bottom edges 22 and 26 of the sidewalls 18 and 20 ensures that a user will not scrape his or her hand on the rasp 36 while using other components of the tool assembly 10. The rasp 36 is mounted to the handle 12 by hooking the front end of the rasp 36 around the first spacer 34 and securing the rear end of the rasp 36 in a slot in a mounting block 37 forward of the second spacer 35 at the second end 16 of the handle 12 (as shown in FIGS. 1 and 4). A bolt 39 extends rotatably through the second spacer 35 and passes threadedly through the mounting block 37. Rotation of the screw 39 causes the mounting block 37 to move along the threads of the bolt 39 towards or away from the second spacer 35. Thus, rotation of the bolt 39 in a first direction will move the mounting block 37 towards the first end 14 of the handle 12, thereby releasing tension of the rasp 36 and enabling the rasp 36 to be removed. A new rasp 36 can be positioned between the first spacer 34 and the mounting block 37. The bolt 39 then is rotated in the opposite direction for moving the mounting block 37 towards the second spacer 36, thereby creating tension on the rasp 36 and holding the rasp 36 tightly in a substantially planar condition recessed slightly up from the bottom edges 22 and 24 of the sidewalls 18 and 20.

The handle 12 further includes a cavity 38 that extends down into the handle 12 between the top edges 24 and 28 of the sidewalls 18 and 20. Additionally, the cavity 38 extends substantially continuously between the first end 14 and the second spacer 35.

The handle 12 may be formed from any rigid durable material. A metallic material, such as a cast aluminum is preferred. However, certain rigid plastics or wood also are acceptable. The handle 12 has an overall length that is dependent upon the lengths of the tools incorporated into the handle 12. In most situations, the handle 12 will have a length between 4–8 inches, and in a preferred embodiment, the handle 12 has a length of about 6.5 inches. The handle 12 has a maximum height that is dependent upon the heights of the tools that will be releasably positioned within the cavity 38. In most situations, the handle will have a height between 1–2 inches, and a preferred embodiment has a handle with a height of about 1.75 inches. However, the height of the handle 12 near the concave areas at the top edges 24 and 28 of the sidewalls 18 and 20 is significantly less than the height at other locations, and sufficient to access the tools in the cavity 38. The handle 12 preferably defines an overall external width in the range of 1–2 inches, and most preferably a width of 1.25–1.5 inches.

The tool assembly 10 further includes a plurality of tools that are pivotally mounted to the handle 12 for movement from closed positions where the respective tools are within the cavity 38 to an open position where at least portions of the respective tools project from the handle 12. In particular, the tool assembly 10 includes a keyhole saw 40 having a rear end 42 and a front end 44. The rear end 42 is connected pivotally to a pivot pin 46 mounted to the handle 12 at a location in proximity to the first end 14, and hence opposite the rounded second end 16 of the handle 12. Thus, the keyhole saw 40 can be rotated from a closed position, as shown in FIG. 1, to an open position, as shown most clearly in FIG. 6. A stop 47*a* projects in from the first sidewall 18 near the first end 14 of the handle 12 to limit the range of rotational movement of the saw 40. A resilient clip 47*b* is provided on the first wall 18 near the pivot pin 46 and functions to releasably lock the rear end of the saw 40 when the saw 40 in the open position and substantially against the stop 47*a*. The resilient clip 47*b* is deflectable about an end 47*c* secured to the first wall 18, and is sufficiently long to ensure easy deflection. The keyhole saw 40 defines a length so that virtually all of the keyhole saw 40 is within the cavity 38 of the handle 12 when the keyhole saw 40 is in the closed position of FIG. 1. The front end 44 of the keyhole saw 40 is sufficiently pointed to be urged through a sheet of gypsum board. The keyhole saw 40 further includes an array of teeth 48 that extends along one longitudinal side of the keyhole saw 40. The teeth 48 are dimensioned and configured to cut conveniently through gypsum board or similar material. Significantly, the teeth 48 are disposed along a side of the keyhole saw 40 that will face into the cavity 38 when the keyhole 40 is rotated into the closed potion of FIG. 1. Hence, a user of the tool assembly 10 cannot cut his or her hand on the teeth 48 when the keyhole saw 40 is in the closed position. The keyhole saw 40 eventually will become worn. Accordingly, the keyhole saw 40 can be removed and replaced with a new sharp keyhole saw 40. In this regard, the keyhole saw 40 can be removed merely by unthreading the pivot pin 46 from the handle. The worn saw 40 then is removed and discarded and a new saw 40 is positioned in the handle so that the aperture near the rear end 42 of the keyhole saw 40 aligns with the pivot pin 46. The pivot pin 46 then is screwed back into the handle. In this regard, the preferred embodiment has no other tools rotatably mounted to the pivot pin 46. Hence, removal and replacement of the keyhole saw 40 can be carried out easily without having to align several tools with the pivot pin 46.

Figure 3:
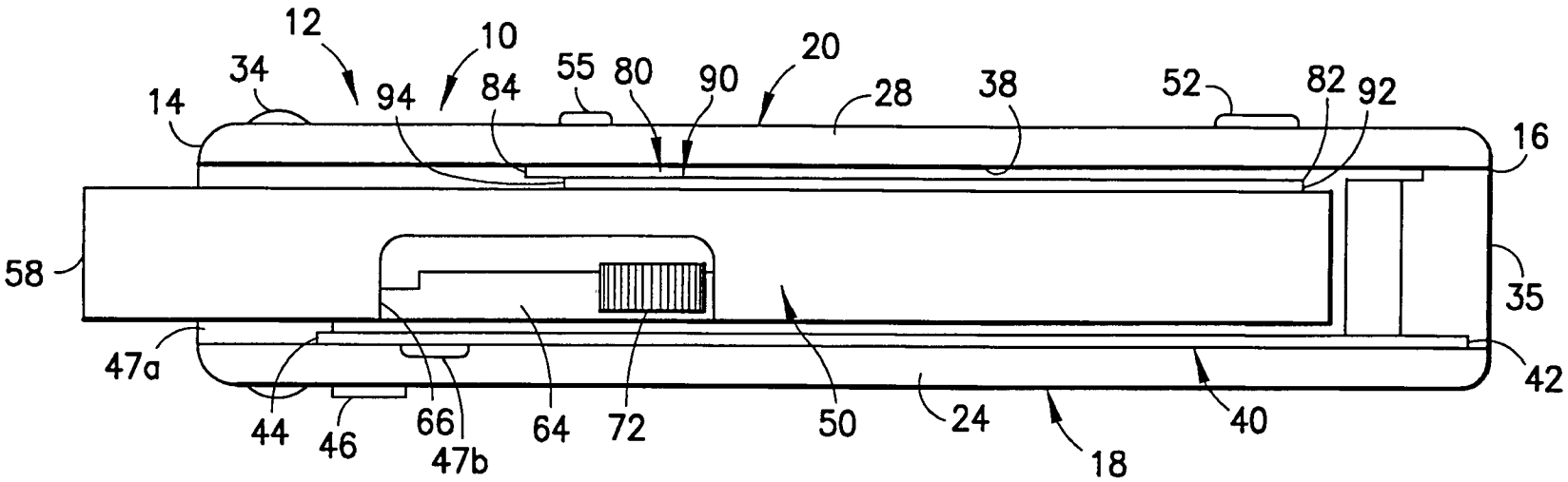
FIG. 3 is a top plan view of the tool with the components of the tool in their close condition.

The tool assembly 10 further includes a utility knife 50 with a housing 54 that has opposite rear and front ends 56 and 58. The rear end 56 of the housing 54 is connected pivotally to the pivot pin 52 of the handle 12. Thus, the housing 54 can be rotated from a closed position where a major portion of the housing 54 is within the cavity 38 of the handle 12, as shown in FIGS. 1 and 3, and an opened position where a major portion of the housing 54 is external of the cavity 38. The housing 54 includes a base 60 and a cover 62 that is mounted removably to the base 60 by a screw 63. A blade chamber 64 is formed in the housing 54 between the base 60 and the cover 62. The housing 54 includes an access opening 66 that extends into the blade chamber 64. Additionally, the housing 54 includes a blade slot 68 that extends into the front end 58 and provides communication with the blade chamber 64.

A blade carriage 70 is mounted slidably in the blade chamber 64 for reciprocal movement in front-to-rear directions relative to the housing 54. The blade carriage 70 includes an actuator button 72 that projects through the access opening 66. The actuator button 72 has a ribbed top surface to facilitate non-slip engagement with a thumb of a user so that the blade carriage 70 can be moved forward and back relative to the housing 54. A blade 74 is mounted removably to the blade carriage 70 and hence moves forward and back with the blade carriage 70 relative to the housing 54 of the utility knife 50. In this regard, the blade carriage 70 and the blade 74 can be moved from a retracted position and an extended position. The blade 74 is disposed safely within the housing 54 when the blade 74 and the carriage 70 are in the retracted position shown in FIGS. 1 and 2. However, the blade 74 projects beyond the front end 58 of the housing 54 when the blade 74 and the blade carriage 70 are in the extended position shown in FIG. 5. The blade 74 can be reversed or replaced merely by releasing the secure cover 62 from the base 60 so that the blade chamber 64 is accessible. Both the carriage 70 and the blade 74 may be of conventional design.

The housing 54 of the utility knife 50 includes a permanent magnet 78 embedded therein. The magnet 78 functions to magnetized the blade 74 so that the blade 74 can be used to position a metal rule or tape. Thus, the magnetized blade 74 enables a worker to score a sheet of gypsum board without the more time consuming procedure of first marking the gypsum board with a pencil and then cutting or scoring the gypsum board along the pencil line. The ability of the magnetized blade 74 to hold the edge of a metal tape leads to significant efficiencies.

Figure 2:
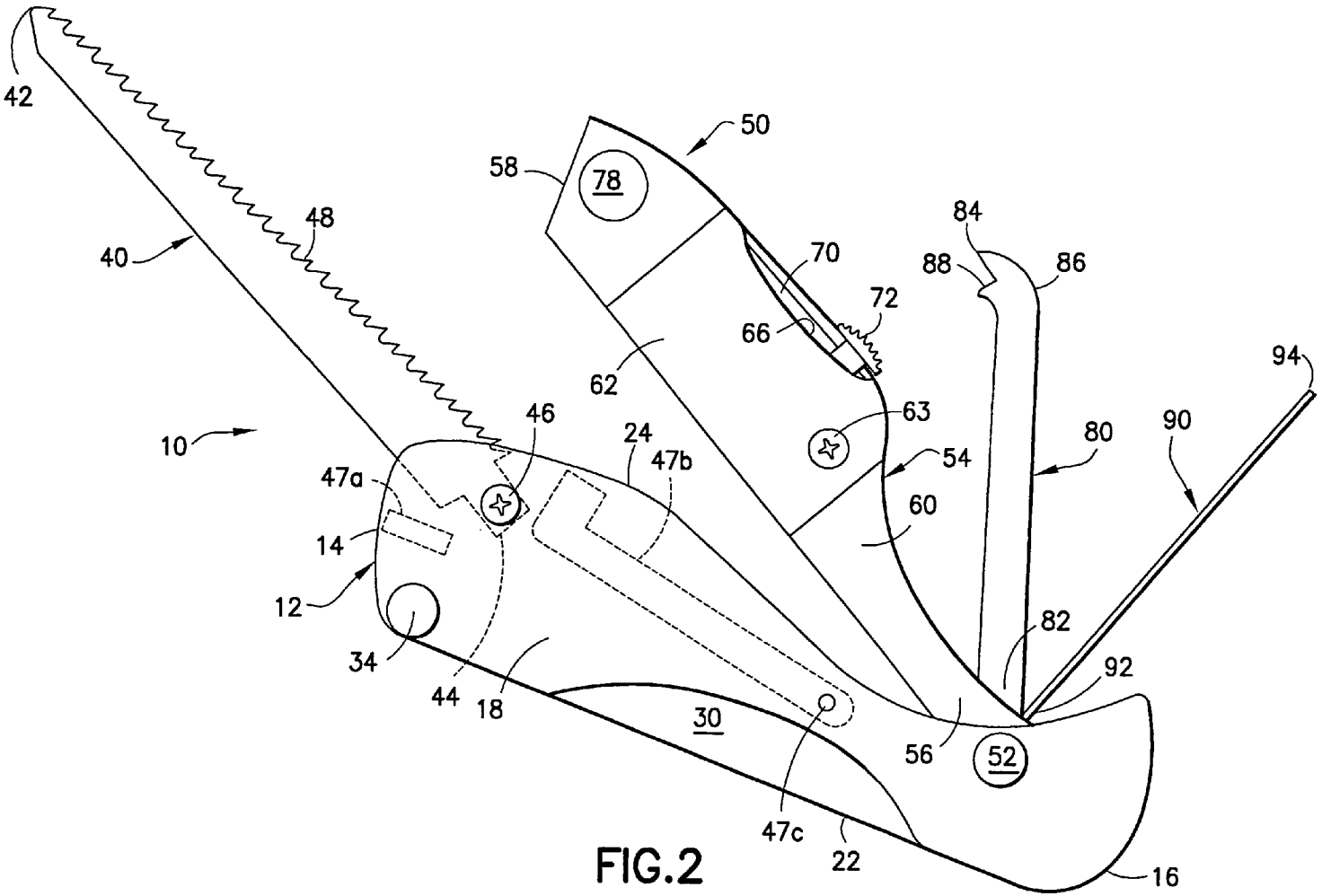
FIG. 2 is a side elevation view of the tool with the various components of the tool in partly open positions.
Figure 5:
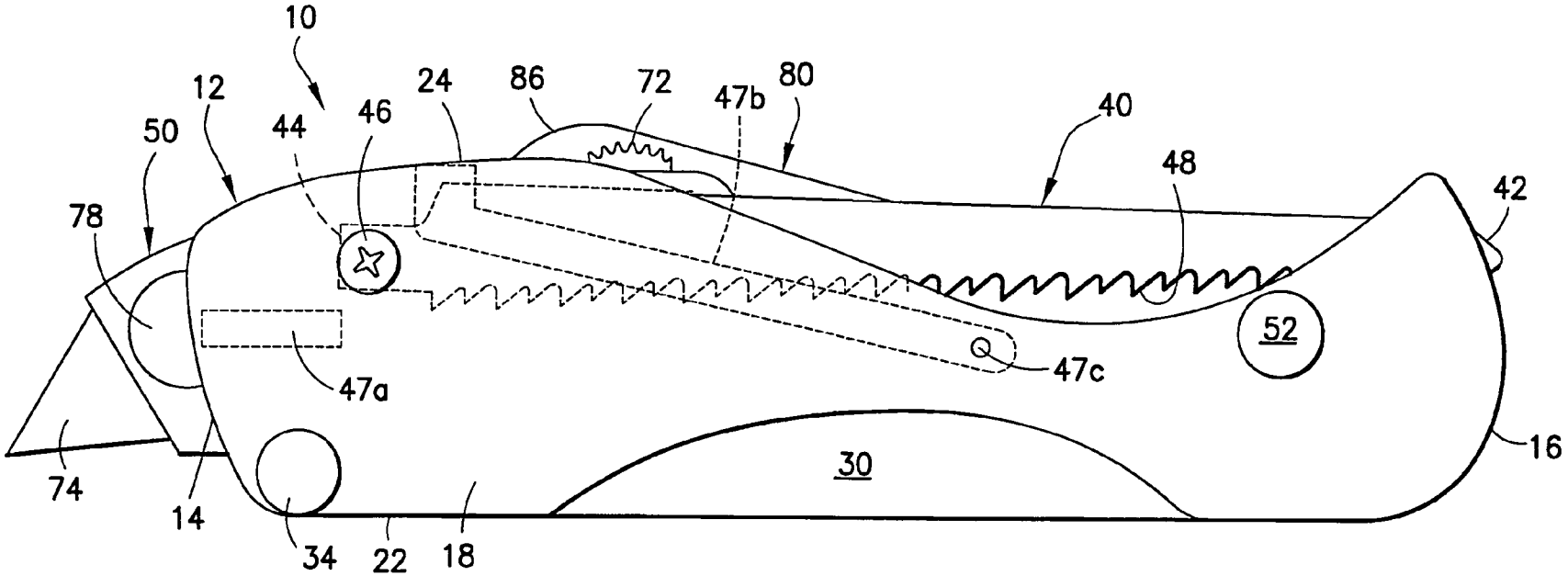
FIG. 5 is a side elevational view with the utility knife in a ready-to-use condition.
Figure 6:
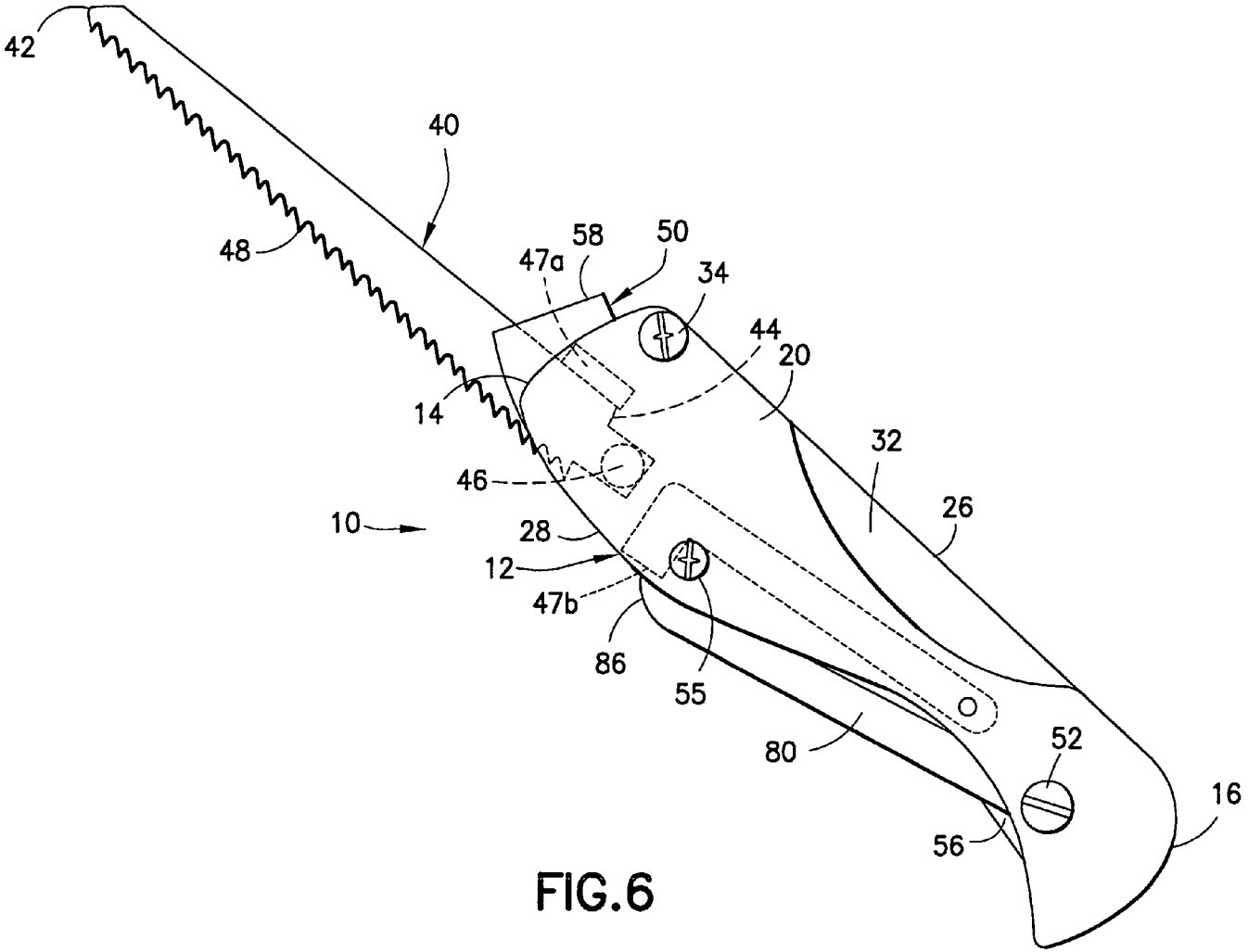
FIG. 6 is a side elevation view of the knife with the keyhole saw in the ready to use condition.

The utility knife 50 can be rotated from an open condition as shown in FIG. 2 to a closed position as shown in each of FIGS. 1 and 3–8. A major part of the utility knife 50 is disposed within the cavity 38 when the utility knife 50 is in the closed position. However, a small section of the utility knife 50 near the front end 58 of the housing 54 projects beyond the first end 14 of the handle 12 when the utility knife 50 is in the closed position. Additionally, the blade 74 will project further from the handle 14 when the blade 74 is in the extended position relative to the housing 54. Unlike the other tools of the assembly 10, the utility knife 50 is in the closed position during use, as shown in FIG. 5. The utility knife 50 is releasably held in the closed position by a screw 55 mounted in the handle 14, however other releasable retention means can be provided, including frictional retention or biasing means. The utility knife 50 generally will be in the open position of FIG. 2 only when the blade 74 is being reversed or changed.

Figure 7:
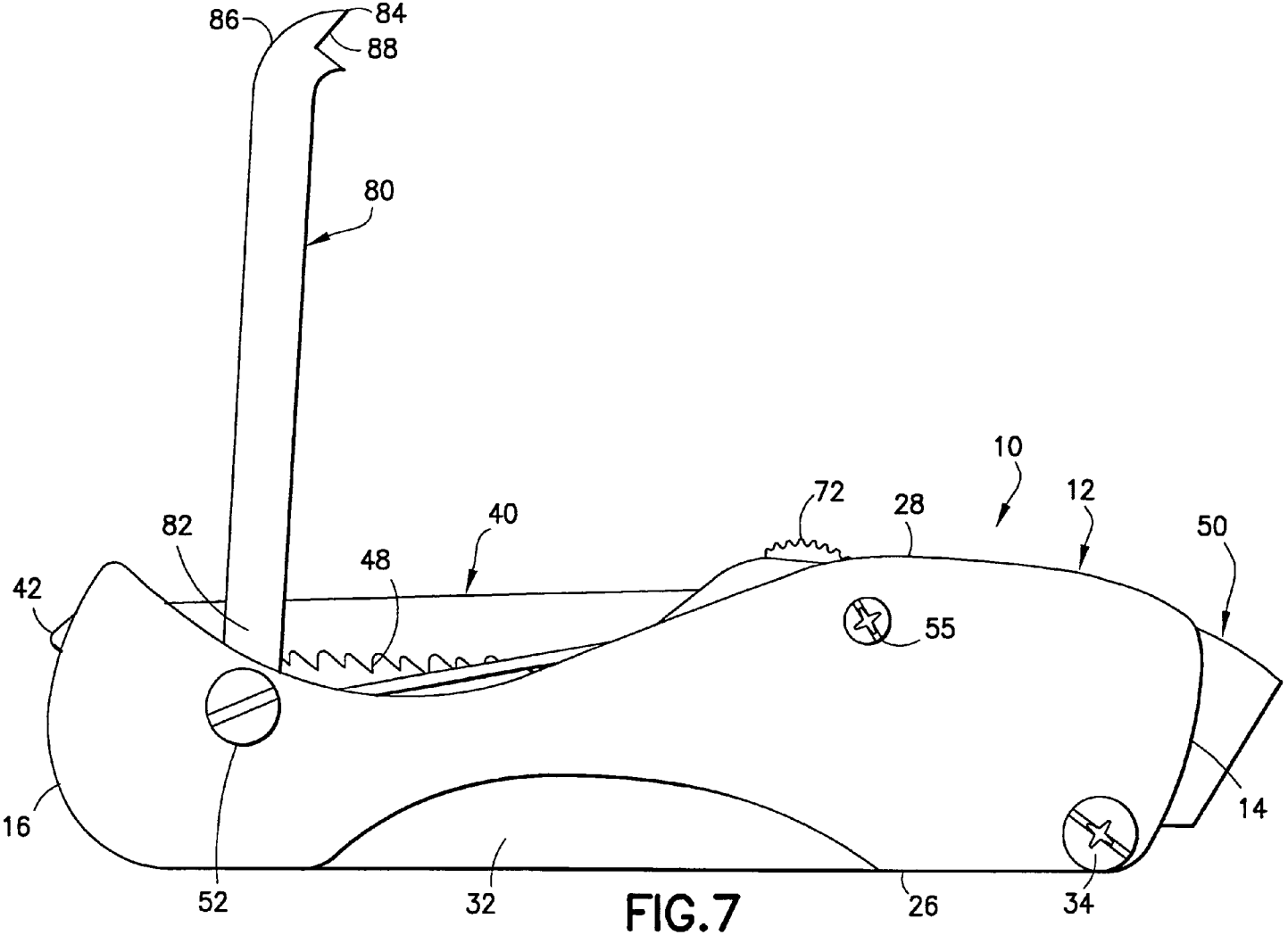
FIG. 7 is a side elevational view of the tool with the pry bar in the ready to use condition.

The tool assembly 10 further include a pry bar 80 with a rear end 82 and a front end 84. The pry bar 80 is formed from a rigid metallic plate material. The rear end 82 of the pry bar 80 is pivotally connected to the handle 12 at the pivot pin 52. The front end 84 of the pry bar 80 includes an arcuate bearing surface 86 and a notch 88 adjacent the bearing surface 86. The extreme front end 84 defines a point between the bearing surface 86 and the notch 88. The pry bar 80 can be rotated from a closed condition as shown in FIGS. 1, 3 and 5–7 and an open position as shown in FIGS. 2 and 7. The pry bar 80 is substantially completely disposed in the cavity 38 when the pry bar 80 is in the closed position. The above-described screw 55 prevents over-rotation of the pry bar 80 into the handle 20, and hence ensures that the pry bar 80 is accessible.

Figure 8:
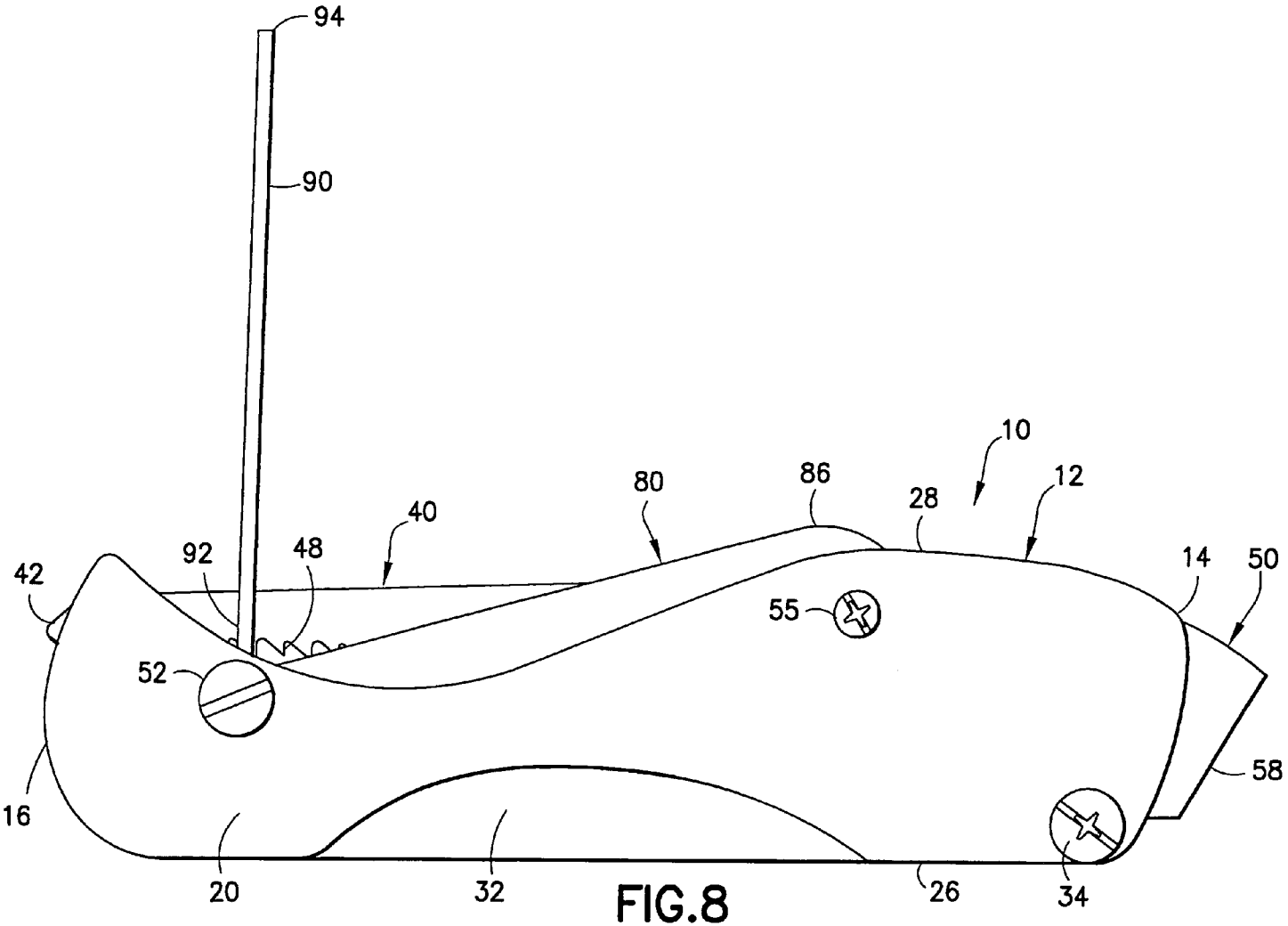
FIG. 8 is a side elevational view of the knife with the punch in a ready to use condition.

The tool assembly 10 further includes a punch 90 having a rear end 92 that is connected pivotally to the pivot pin 52 and a front end 94 opposite the rear end 92. Thus, the punch 90 can be rotated from an open position as shown in FIGS. 2 and 8 and a closed position shown in FIGS. 1, 3–6 and 8. The punch 90 is formed from a rigid metallic material (e.g. aluminum) and is sufficiently narrow (e.g. ⅛ inch) to be urged into the tip of a tube of silicone sealant or construction adhesive for puncturing the foil across the tube. The above-described screw 55 limits the rotation of the punch 90 into the handle 20.

The tool assembly 10 can be used to perform a wide variety of work for a carpenter, a home improvement enthusiast or any other person who is installing gypsum board. The tool assembly 10 normally is stored in the FIG. 1 condition so that virtually all sharp parts of the tool assembly 10 are concealed or recessed. In a typical situation, a worker will first use the utility knife 50 of the tool assembly 10. Thus, the user will exert pressure with a thumb or forefinger on the actuator button 72 to advance the blade carriage 70 from the retracted position of FIG. 1 into the extended condition of FIG. 5. The user then grasps the handle 12 with the heel of the palm comfortably engaged over the concave region on the top edges 24 and 28 of the sidewalls 18 and 20. The blade 74 can be retracted safely into the housing 54 when the user completes a cut with the utility knife 50.

The blade 74 will have to be replaced or reversed periodically. The blade 74 is accessed by rotating the utility knife 50 from the FIG. 1 or 5 condition into the FIG. 2 condition. The cover 62 of the housing 54 then is removed from the base 60. The blade 74 then can be separated from the carriage 70 and either reversed or replaced. The cover 62 then is secured back on the base 60.

The edge of the gypsum board cut with the utility knife 50 may include rough areas or may require further trimming. This trimming is carried out using the rasp 36 as shown in FIG. 4. More particularly, the user grabs the handle 12 with the heal of the palm of the hand in the concave areas of the top edges 24 and 28 of the sidewalls 18 and 20 and with the thumb and forefingers engaged respectively in the recesses 30 and 32. The rasp 36 then is engaged against the edge of the gypsum board. The user then urges the tool assembly 10 linearly along the edge of the gypsum board so that the rasp 36 abrades the gypsum board sufficiently to remove rough edges or to accommodate dimensional requirements.

The user of the tool assembly 10 may periodically have to cut a hole in a piece of gypsum board. This occurs for example, when a hole must be formed for an electrical outlet, heating duct or the like. In this situation, the keyhole saw 40 is rotated about the pivot pin 46 from the FIG. 1 orientation into the FIG. 6 orientation. Rotation of the saw 40 stops when the saw 40 engages the stop 47*a*. Simultaneously, the clip 47*b* snaps into engagement with the saw 40 to hold the saw 40 releasably in the FIG. 6 orientation. The user then holds the handle 12 in an inverted condition relative to the orientation used to employ the utility knife 50. The recesses 30 and 32 in the sidewalls 18 and 20 accommodate the heel of the palm of the user's hand to achieve a secure griping. The keyhole saw 40 can be used by first urging the pointed front end 44 of the keyhole saw 40 into and through the gypsum board by hitting the open palm of the hand against the rounded second end 16 of the handle 12. The tool assembly 10 then is reciprocated so that the teeth 48 of the keyhole saw 40 cut through the gypsum board. After use, the clip 47*b* is deflected and the keyhole saw 40 is rotated about the pivot point 46 and back into the safely stored condition of FIG. 1. As shown in FIG. 1, the sharp teeth 48 of the keyhole saw 40 point into the cavity 38 to avoid accidental injuries to the hand.

The keyhole saw 40 and the utility knife 50 generally are used at precisely marked positions on the gypsum board. These positions are measured relative to an uncut edge of the gypsum board and are marked with a pencil. The worker then employs either the keyhole saw 40 or the utility knife 50 to perform a specified cutting operation. The marking of the gypsum board is important, time consuming and occasionally difficult. Marking of the gypsum board can be completely avoided by using the magnet 78. In this regard, the permanent magnet 78 functions to magnetize the blade 74. The magnetized blade 74 can be advanced into the FIG. 5 condition and can be used to hold the edge of a metallic tape. The gypsum board then is scored directly with the magnetized blade 74 at the position indicated by the metallic tape, thereby avoiding the need to first mark the gypsum board with a pencil. Thus, this combination of the magnetized blade and the ferrous metallic ruler or tape functions in much the same way as a square, but with a much smaller size and with an ability to perform other functions. Accordingly, proper use of the magnetized blade 74 achieves considerable time efficiencies, as compared to optional pencil marking and cutting procedures, and space efficiencies, as compared to large scares and such.

The gypsum board typically is mounted to a wall or ceiling using drywall screws. The screws are installed with a drill and are urged through the gypsum board and into a stud. Periodically, a drywall screw will miss a stud and must be separated from the gypsum board. This separation can be achieved using the pry bar 80 of the tool assembly 10. In particular, the pry bar 80 is rotated from the closed position shown in FIG. 1 to the opened position of FIG. 8. The pointed end 84 then is urged under the head of the drywall screw and the pry bar 80 is rotated about the curved bearing surface 86 to generate outwardly directed forces on the drywall screw. The pry bar 80 can be used in combination with a drill operated in the reverse mode.

The worker may want to employ an adhesive to secure the gypsum board to a wall and/or a silicone sealant along certain joints, such as in joints around windows or doors. The adhesives and sealants typically are sold in a cylindrical tube that has a conical nozzle at one end. A foil or plastic seal extends across the end of the tube beneath the nozzle. The tube can be mounted in an appropriate caulking gun that urges the rear wall of the tube forwardly. However, the worker must form an opening in the front end of the tube. For this purpose, the worker moves the blade 74 of the utility knife 50 forwardly from the FIG. 1 retracted condition to the FIG. 5 extended condition and then cuts through the tip of the nozzle at an appropriate position to define an opening with a cross section suitable for the desired bead of adhesive or silicone sealant. The worker then retracts the blade 74 from the FIG. 5 condition into the FIG. 1 condition and rotates the punch 90 from the FIG. 1 condition into the FIG. 7 condition. The worker then holds the handle 12 and urges the beveled front end 94 of the punch 90 through the cut-open end of the nozzle sufficiently for the front end 94 of the punch 90 to pierce through the foil or plastic seal of the tube. The adhesive or sealant then can be applied by using the caulking gun in the conventional manner.

While the invention has been described with respect to a preferred embodiment, it is apparent that various changes can be made without departing than the scope of the invention as defined by the appended claims.

What is claimed is:

1. A tool assembly comprising an elongate handle with opposite first and second ends, first and second side walls extending between the ends, a top and a bottom extending between the ends and the side walls, a rasp extending along the bottom of the handle and being recessed into the handle relative to bottom edges of the side walls, a utility knife having a housing with opposite front and rear ends, the rear end of the housing being pivotally mounted to the handle so that the utility knife housing can be rotated selectively into and out of the handle, the utility knife having a blade slidably mounted in the housing for movement relative to the housing between a retracted position where the blade is within the housing and an extended position where a portion of the blade projects from the housing, a saw having opposite front and rear ends, the rear end of the saw being pivoted to the handle so that the saw can be rotated from a closed position substantially in the handle and an open position where the front end of the saw projects from the handle, an array of teeth extending along one side edge of the saw and being disposed to face into the handle when the saw is in the closed position.

2. The tool assembly of claim 1, wherein the handle includes a cavity extending into the top and between the sidewalls, the utility knife being substantially within the cavity when the utility knife is in the closed position.

3. The tool assembly of claim 1, wherein the housing of the utility knife has a permanent magnet securely mounted therein at a position substantially adjacent the front end of the housing and substantially adjacent the blade, whereby the magnet functions to magnetize the blade.

4. The tool assembly of claim 1, further comprising a pry bar pivotally mounted to the handle and rotatable from a closed position where the pry bar is within the handle and an open position where the pry bar projects from the handle.

5. The tool assembly of claim 1, further comprising a punch pivotally mounted to the handle and rotatable from a closed position where the punch is within the handle and an open position where the punch projects from the handle.

6. The tool assembly of claim 1, further including a retainer movably mounted to the handle for releasably retaining the housing of the utility knife in the handle of the tool assembly.

7. A tool assembly comprising an elongate handle, the handle including first and second opposite ends, a cavity extending into the handle and extending substantially between the ends, a utility knife having a housing with opposite front and rear ends, the rear end of the housing of the utility knife being pivotally connected to the second end of the handle so that at least a portion of the housing of the utility knife can be rotated selectively into and out of the cavity in the handle of the tool assembly, the utility knife having a blade slidably mounted in the housing for movement relative to the housing between a retracted position where the blade is within the housing and an extended position wherein the blade of the utility knife is projectable from the housing, the housing of the utility knife being dimensioned so that the blade extends from the first end of the handle when the housing of the utility knife is pivoted into the cavity of the handle and when the blade is in the extended position, a saw having opposite front and rear ends, the rear end of the saw being pivoted to the first end of the handle so that that saw can be rotated from a closed position substantially in the handle and an open position where the front end of the saw projects from the handle, an array of teeth extending along one side edge of the saw and being disposed to face into the cavity in the handle when the saw is in the closed position.

8. The tool assembly of claim 7, wherein the handle includes a bottom extending between the ends and substantially opposite the cavity, a rasp extending along the bottom of the handle.

9. The tool assembly of claim 8, wherein the rasp is recessed relative to adjacent edges of the handle.

10. The tool assembly of claim 7, wherein the housing of the utility knife includes a base and a cover removably mounted to the base and defining a blade chamber therebetween, a blade carriage being slidably mounted in the blade chamber for movement between a retracted position and an extended position, the blade being removably mounted to the carriage and being accessible when the cover is removed from the base, wherein the cover is at least partly between the sidewalls of the handle when the utility knife is in the closed position for substantially preventing removal of the cover and wherein the cover is spaced from the handle when the utility knife is in the open position for permitting removal of the cover and accessing the blade chamber.

11. The tool assembly of claim 10, wherein the housing has a window communicating with the blade chamber, the blade carriage having an actuating button projecting through the window for moving the blade carriage relative to the housing.

12. The tool assembly of claim 7, further including a retainer movably mounted to the handle for releasably retaining the housing of the utility knife in the handle of the tool assembly.

13. A tool assembly having an elongate handle with opposite sidewalls each of which has opposite top and bottom edges, the handle having a cavity between the top edges of the sidewalls and a recess between the bottom edges of the sidewalls, a rasp mounted to the handle in the recess between the bottom edges of the sidewalls, a utility knife having a housing with opposite front and rear ends, the rear end of the housing being pivotally mounted to the handle so that the utility knife can be rotated selectively into and out of the cavity of the handle, the utility knife having a blade projecting from the handle when the housing is in the cavity, the housing of the utility knife having a cover that is removable when the housing is out of the cavity for accessing and replacing the blade of the utility knife.

14. The tool assembly of claim 13, wherein the rasp is recessed relative to the bottom edges of the sidewalls of the handle for substantially preventing injury.

15. The tool assembly of claim 13, wherein the blade is movably disposed in the housing of the utility knife between an extended position where the blade projects from the housing to a retracted position where the blade is in the housing.

16. The tool assembly of claim 15, further comprising an elongate punch pivotally connected to the handle and rotatable from an open position where a free end of the punch projects from the handle and a closed position where at least a portion of the punch is within the cavity.

17. The tool assembly of claim 15, further comprising a pry bar having a pointed front end and an arcuate bearing surface adjacent the pointed front end, the pry bar further having a rear end pivotally mounted to the handle so that the pry bar is rotated into and out of the cavity.

18. The tool assembly of claim 15, further comprising a saw pivotally mounted to the handle and movable from a closed position to an open position relative to the cavity, the saw having an array of teeth projecting into the cavity of the handle when the saw is in the close position.

19. The tool assembly of claim 13, wherein the housing of the utility knife has a permanent magnet in proximity to the front end of the housing for magnetizing the utility knife blade.

20. A tool assembly comprising:

an elongate handle having opposite first and second ends, sidewalls extending substantially between the first and second ends, the sidewalls each having a top edge and a bottom edge, a cavity extending into the housing between the top edges of the sidewalls;

a rasp secured to the housing and being recessed relative to the bottom edges of the sidewalls;

a utility knife mounted to the handle and having a blade movable from an extended position where the blade projects from the first end of the handle and a retracted position where the blade is retracted;

a saw pivotally mounted to the housing for movement between a closed position and an open position, the saw having an array of teeth projecting into the cavity when the saw is in the closed position, the teeth being exposed externally of the handle when the saw is in the open position;

a pry bar having a rear end pivotally connected to the housing and an opposed front end, the pry bar being rotatable from an open position where front end of the pry bar projects from the housing and a closed position where at least portions of the pry bar are in the cavity; and a punch having a rear end pivotally mounted to the handle and a pointed front end, the punch being rotatable from an open position where the front end projects from the handle and a closed position where at least portions of the punch are in the cavity.

21. The tool assembly of claim 20, wherein the utility knife has a housing with a rear end pivotally connected to the handle and a front end, the blade being disposed to project from the front end housing when the blade is in the extended position.

22. The tool assembly of claim 21, wherein the rear end of the housing is pivotally connected to the second end of the handle, the handle further including a retainer movably mounted therein for releasably holding the housing of the utility knife in a pivoted condition substantially in the handle of the tool assembly.

23. The tool assembly of claim 21, wherein housing of the utility knife includes a removable cover for accessing and changing the blade.

24. The tool assembly of claim 23, wherein the cover of the housing of the utility knife is accessible when the housing of the utility knife is rotated into the open position.

* * * * *